US008689448B2

(12) United States Patent
Ren

(10) Patent No.: US 8,689,448 B2
(45) Date of Patent: Apr. 8, 2014

(54) RAZOR HEAD AND OUTER FRAME THEREOF

(76) Inventor: Xiangrong Ren, Wenzhou (CN)

( * ) Notice: Subject to any disclaimer, the term of this patent is extended or adjusted under 35 U.S.C. 154(b) by 188 days.

(21) Appl. No.: 13/384,824

(22) PCT Filed: Jul. 30, 2010

(86) PCT No.: PCT/CN2010/075601

§ 371 (c)(1),
(2), (4) Date: Jan. 19, 2012

(87) PCT Pub. No.: WO2011/015118

PCT Pub. Date: Feb. 10, 2011

(65) Prior Publication Data

US 2012/0151775 A1 Jun. 21, 2012

(30) Foreign Application Priority Data

Aug. 6, 2009 (CN) ..... 2009 2 0061896

(51) Int. Cl.
*B26B 19/00* (2006.01)

(52) U.S. Cl.
USPC ..... 30/34.1; 30/50; 30/52

(58) Field of Classification Search
USPC ..... 30/50, 52, 34.1, 334, 338, 337, 51
See application file for complete search history.

(56) References Cited

U.S. PATENT DOCUMENTS

| | | | | |
|---|---|---|---|---|
| 4,403,412 | A * | 9/1983 | Trotta | 30/47 |
| 5,918,369 | A * | 7/1999 | Apprille et al. | 30/47 |
| 6,035,537 | A * | 3/2000 | Apprille et al. | 30/346.5 |
| 6,044,542 | A * | 4/2000 | Apprille et al. | 29/525.05 |
| 7,100,284 | B2 * | 9/2006 | King | 30/49 |
| 7,669,335 | B2 * | 3/2010 | Walker et al. | 30/34.1 |
| 7,966,731 | B2 * | 6/2011 | Walker et al. | 30/34.1 |
| 8,234,789 | B2 * | 8/2012 | Avens et al. | 30/50 |
| 2005/0198841 | A1 * | 9/2005 | Worrick, III | 30/527 |
| 2006/0179661 | A1 * | 8/2006 | Walker et al. | 30/50 |
| 2007/0028449 | A1 * | 2/2007 | King | 30/49 |
| 2007/0193042 | A1 * | 8/2007 | Worrick et al. | 30/527 |

* cited by examiner

*Primary Examiner* — Omar Flores Sanchez
(74) *Attorney, Agent, or Firm* — Shimokaji & Associates P.C.

(57) ABSTRACT

An outer frame of a razor head includes two side parts, a front part and a rear part connecting the side parts. An inner side wall of each side part provides a positioning block which has a first plane for mounting and supporting razor blade assemblies. Resilient arms are connected with side walls of the positioning blocks. Each resilient arm includes a leg part connecting the positioning block and a head part connecting an end of the leg part. An inclination angle between the leg part and the first plane is in the range of 25°~30°. The head part is extended out of the first plane. The resilient arm can provide a suitable supporting force to a razor blade holder within its allowable range to be prevented from being fractured easily, and in turn improve the using performance of the outer frame and extend its lifetime.

10 Claims, 4 Drawing Sheets

RAZOR HEAD AND OUTER FRAME THEREOF

FIELD OF THE INVENTION

The present invention relates to a razor apparatus and, particular to an outer frame of a razor head and a razor head with the same.

BACKGROUND OF THE INVENTION

Razors include two types commonly which are razors that the razor head is integrated with the handle, and razors that the razor head and the handle are detachable. Therein, the razor head of the former is directly fixed on the handle, while the razor head of the latter is connected with the handle via a connection part, and the handle is detachable and replaceable.

Generally, the current razor head includes an outer frame and a plurality of razor blade assemblies, and the razor blade assembly includes a razor blade holder and razor blades fixed on the razor blade holder. Positioning blocks are symmetrically formed on the two side walls of the outer frame, and the positioning blocks have a first plane for mounting and supporting the razor blade assemblies. And the positioning blocks are arranged with spaced each other and then form several grooves, the lower end of the razor blade holder is mounted within the groove, and a restricted buckle is mounted on the outer frame so as to maintain the razor blade assemblies in a predetermined position. Resilient arms are connected with the side wall of the positioning blocks, and each of resilient arms includes a leg part connected with the positioning block and a head part formed on the end of the leg part. The head part provides an upward elastic supporting force to the razor blade assemblies. While shaves, the razor blade assemblies can be maintained within the outer frame and moved up and down by pressing the head part, and the planes of the razor blades are parallel to the first plane during shaving.

Concretely, the upward force F that the head part applies to the razor blade holder is a linear function of a downward displacement Y: $F=K\times Y$, wherein K is the spring constant (depended on the length L, inertia moment I and modulus of elasticity E of the resilient arm, $K=L3/(3EI)$) which is a constant, and $Y=Y_p+Yd$, and $Y_p$ is the downward offset distance of the head part of the resilient arm after the razor blade assemblies and the restricted buckle assembled, $Y_d$ is the downward offset distance of the head part during shaving. Therefore, the degrees of the inclination angle between the leg part of the resilient arm and the first plane are the main factor that determines $Y_p$ which is the main factor determining the upward force F the head part applying to the razor blade holder, that is, the degrees of the inclination angle between the leg part and the first plane directly affect the upward force F that the head part applies to the razor blade holder.

However, the current outer frame of the razor head exist two drawbacks as following:

(a) The inclination angle between the leg part of the resilient arm and the first plane is too small, and the downward offset distance $Y_p$ of the head part of the resilient arm after the razor blade assemblies and the restricted buckle assembled is relative small, which cause the upward force F that the head part applies to the razor blade holder is too small. Thus, this outer frame has a poor using performance.

(b) The inclination angle between the leg part of the resilient arm and the first plane is too large, and the downward offset distance $Y_p$ of the head part of the resilient arm after the razor blade assemblies and the restricted buckle assembled is overlarge, thus the elastic deformation of the resilient arm is overlarge, which easily causes fractures of the resilient arm during shaving. Thus, this outer frame has a short lifetime.

Therefore, there is a need to provide an outer frame and a razor head with the same with good using performance and long lifetime.

SUMMARY OF THE INVENTION

One objective of the present invention is to provide an outer frame of a razor head with good using performance and long lifetime.

Another objective of the present invention is to provide a razor head with good using performance and long lifetime.

To achieve the above-mentioned objectives, the present invention provides an outer frame of a razor head, which includes two side parts, a front part and a rear part connecting with the two side parts respectively. An inner side wall of each of the side parts is provided with a positioning block which has a first plane for mounting and supporting razor blade assemblies. Resilient arms are connected with side walls of the positioning blocks, and each of the resilient arms includes a leg part connected with the positioning block and a head part connected with an end of the leg part. An inclination angle between the leg part and the first plane is in the range of 25°~30°, and the head part is extended out of the first plane.

Preferably, the inclination angle between the leg part and the first plane is 28°.

Preferably, the radius of curvature of a connection position between the leg and the positioning block is in the range of 0.03 mm~1.0 mm.

Preferably, the radius of curvature is in the range of 0.05 mm~0.50 mm.

Preferably, the radius of curvature is in the range of 0.1 mm~0.2 mm.

Preferably, the resilient arms and the positioning block are a unitary structure.

Accordingly, the present invention provides a razor head, which includes an outer frame, at least one razor blade assembly formed on the outer frame in parallel, and a restricted buckle for restricting the razor blade assembly on the outer frame. The outer frame includes two side parts, a front part and a rear part connecting with the two side parts respectively. An inner side wall of each of the side parts is provided with a positioning block which has a first plane for mounting and supporting razor blade assemblies. Resilient arms are connected with a side wall of the positioning block, and each of the resilient arms includes a leg part connected with the positioning block and a head part connected with an end of the leg part. An inclination angle between the leg part and the first plane is in the range of 25°~30°, and the head part is extended out of the first plane.

Preferably, the inclination angle between the leg part and the first plane is 28°.

Preferably, the radius of curvature of a connection position between the leg and the positioning block is in the range of 0.03 mm~1.0 mm.

Preferably, the radius of curvature is in the range of 0.05 mm~0.50 mm.

Preferably, the radius of curvature is in the range of 0.1 mm~0.2 mm.

Preferably, the resilient arms and the positioning block are a unitary structure.

Compared with the prior art, the present invention provides a suitable inclination angle between the leg of the resilient arm of the outer frame and the said first plane, so that the resilient arm can provide a suitable supporting force to a razor blade holder within its allowable range to be prevented from being fractured easily, and in turn improve the using performance of the outer frame and extend the lifetime thereof. Accordingly, the razor head of the present invention includes the outer frame so as to obtain a using performance and long lifetime.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

A distinct and full description of the technical solution of the present invention will follows by combining with the accompanying drawings. By all appearances, the embodiments to be described just are a part of embodiments of the present invention, not the all. Based on the embodiment of the present invention, all other embodiments obtained by the person ordinarily skilled in the art without any creative work pertain to the protection scope of the present invention.

Figure 1:
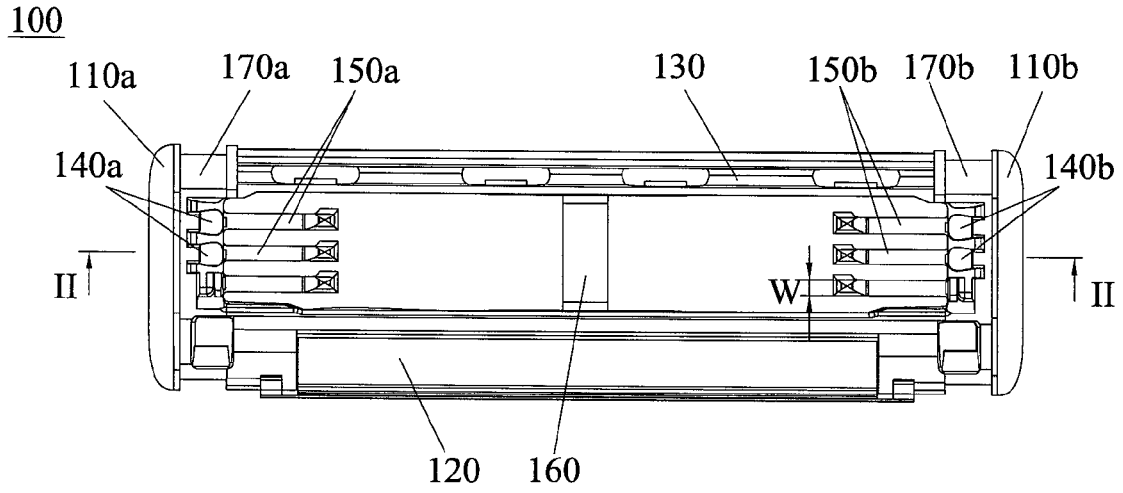
FIG. 1 is a schematic diagram of an outer frame of a razor head according to an embodiment of the present invention.

FIG. 1 is a schematic diagram of an outer frame of a razor head according to an embodiment of the present invention.

Referring to FIG. 1, the present invention provides an outer frame 100 of a razor head, which includes two side parts 110*a*, 110*b*, and a front part 120 and a rear part 130 connecting with the two side parts 110*a*, 110*b* respectively. The front part 120 is connected with the middle of the rear part 130 via a connection part 160, and the structure of the outer frame 100 is symmetrical with the connection part 160. Therein, the inner side wall of each of the side parts 110*a*, 110*b* is provided with positioning blocks 140*a*, 140*b*, and the positioning blocks 140*a*, 140*b* and the outer frame 100 are formed into a unitary structure.

Figure 2:
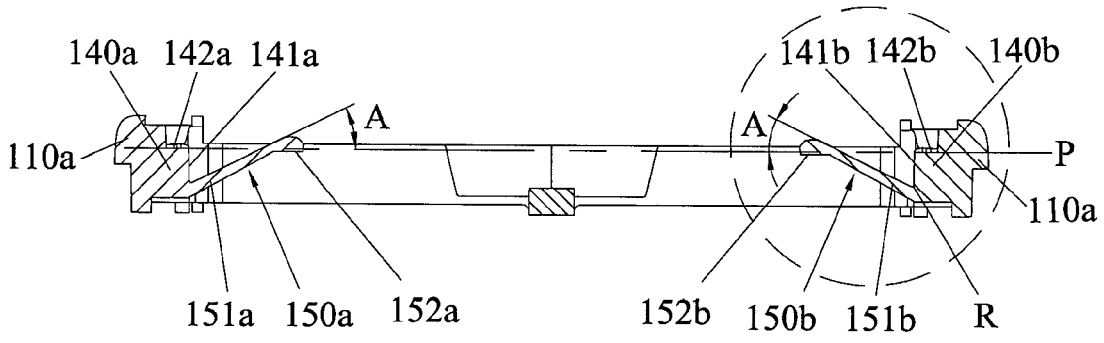
FIG. 2 is a sectional view of the outer frame along II-II line shown in FIG. 1.

As shown in FIG. 2, a resilient arm 150*a* is connected with the lower end of the side wall 141*a* of the positioning block 140*a*. Preferably, the resilient arm 150*a* and the positioning block 140*a* are a unitary structure. The resilient arm 150*a* includes a leg part 151*a* connected with the positioning block 140*a* and a head part 152*a* formed on the end of the leg part 151*a*, and the head part 152*a* has a trapezoidal cross section. Similarly, the lower end of the side wall 141*b* of the positioning block 140*b* also has a resilient arm 150*b* formed, the resilient arm 150*b* and the positioning block 140*a* are a unitary structure as well. The resilient arm 150*b* includes a leg part 151*b* connected with the positioning block 140*b* and a head part 152*b* formed on the end of the leg part 151*b*, and the head part 152*b* has a trapezoidal cross section.

Concretely, a top surface 142*a* of the positioning block 140*a* and a top surface 142*b* of the positioning block 140*b* provide a first plane P for mounting and supporting razor blade assemblies. The head parts 152*a*, 152*b* are extended out of the first plane P, and both of the leg parts 151*a*, 151*b* and the first plane P form an inclination angle A respectively which is in the range of 25°~30°. When the inclination angle A is any one degree in the range of 25°~30°, the resilient arms 150*a*, 150*b* within its alterable range can provide a suitable supporting force to a razor blade holder mounted thereon without fracture, so as to ensure that the outer frame possesses a good performance and a long lifetime. In the present embodiment, the inclination angle A is 28° as the best option.

Figure 3:
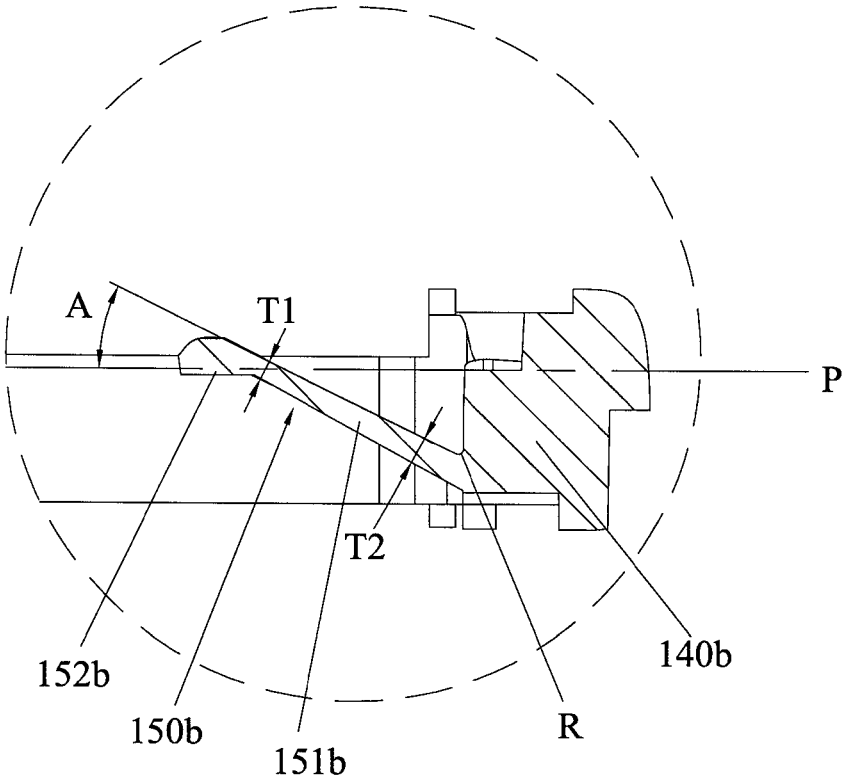
FIG. 3 is a partially enlarged view of the outer frame shown in FIG. 1.

As shown in FIG. 3, the connection position between the leg part 151*b* and the positioning block 140*b* has a radius of curvature R in the range of 0.03 mm~1.0 mm. When the radius of curvature R is any one value within the range of 0.03 mm~1.0 mm, the elasticity of the resilient arm 150*b* is improved, and the strength of the connection position between the leg part 151*b* and the positioning block 140*b* is enhanced, so as to prevent the fracture of the leg part 151*b*. Preferably, the radius of curvature R is in the range of 0.05 mm~0.50 mm, and in the range of 0.1 mm~0.2 mm best. In the present embodiment, the radius of curvature R is 0.15 mm.

Concretely, the width W of the resilient arm 150*b* is in the range of 0.80 mm~0.90 mm, preferably, in the range of 0.83 mm~0.85 mm. Therein, the leg part 151*b* of the resilient arm 150*b* has a slender upper portion connected with the head part 152*b* and a stout lower portion connected with the positioning block 140*b*. The upper portion of the leg part 151*b* has a thickness T1 in a range of 0.40 mm~0.50 mm, preferably, the thickness T1 is in the range of 0.42 mm~0.47 mm. The lower portion of the leg part 151*b* has a thickness T2 in a range of 0.51 mm~0.55 mm, preferably, the thickness T1 is in the range of 0.51 mm~0.53 mm. In the present embodiment, the width W is 0.84 mm, the thickness T1 is 0.45 mm, and the thickness T2 is 0.52 mm.

Figure 4:
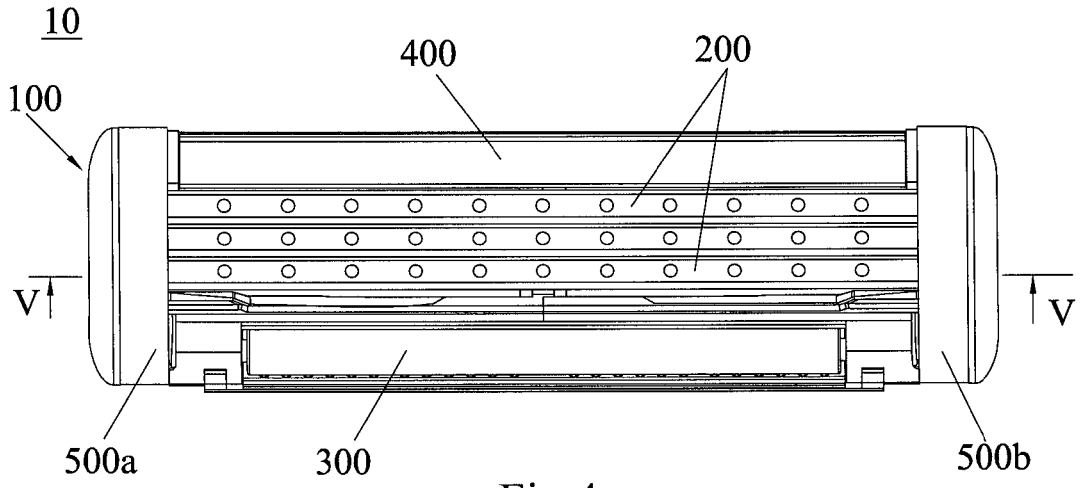
FIG. 4 is a schematic diagram of a razor head according to a first embodiment of the present invention.
Figure 5:
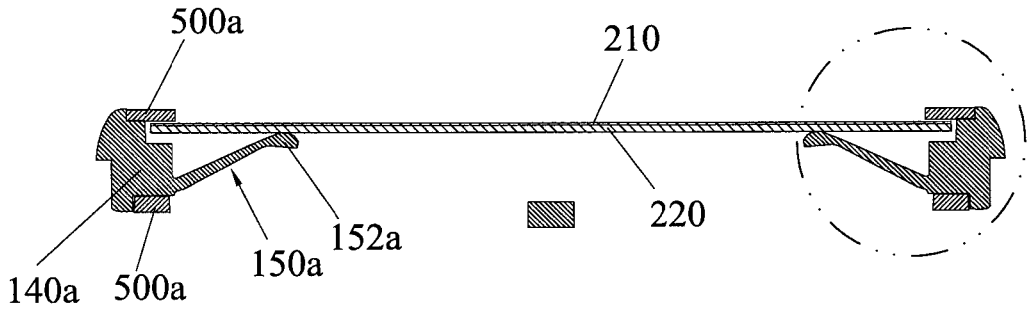
FIG. 5 is a sectional view of the razor head along V-V line shown in FIG. 4.

FIG. 4 shows a razor head according to a first embodiment of the present invention. As shown, the present invention provides a razor head 10, which includes the said outer frame 100, razor blade assemblies 200 formed on the outer frame 100 in parallel, a guide roller 300 and a lubrication bar 400. As shown in FIG. 5, the razor blade assembly 200 includes a razor blade 210 and razor blade holder 200 for supporting the blade 210. The guide roller 300 is mounted on the front part 120 of the outer frame 100 and located at the front of the razor blade assemblies 200, so that the best shaving angle can be maintained during the razor head 10 is using, and in turn the shaving efficiency and the security during shaving can be improved. And the lubrication bar 400 is formed on the rear part 130 of the outer frame 100 and located at the rear of the razor blade assemblies 200. The lubrication bar 400 includes water-solubility polymer and water-fast polymer, which can lubricate and protect the skin while shaving. Concretely, the razor head 10 further includes a pair of restricted rings 500*a*, 500*b* respectively mounted on the inner concave parts 170*a*, 170*b* that are formed on the outer frame 100, so as to restrict the razor blade assemblies 200 beyond the outer frame 100.

Figure 6:
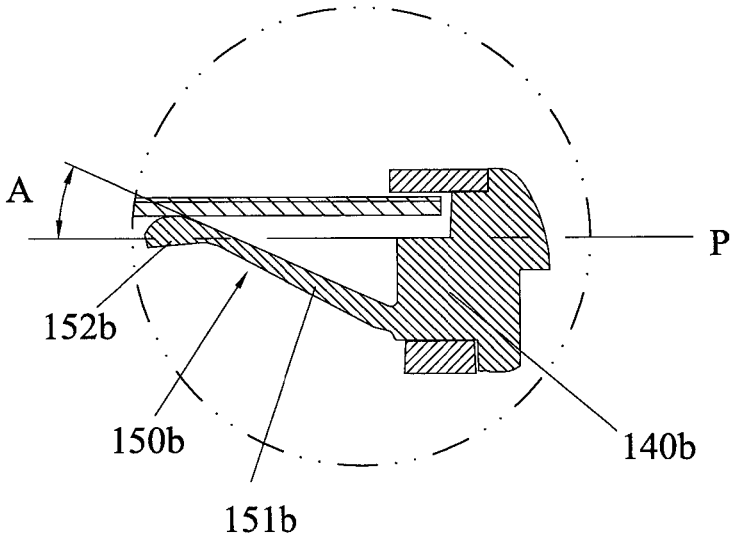
FIG. 6 is a partially enlarged view of the razor head shown in FIG. 5.
Figure 7:
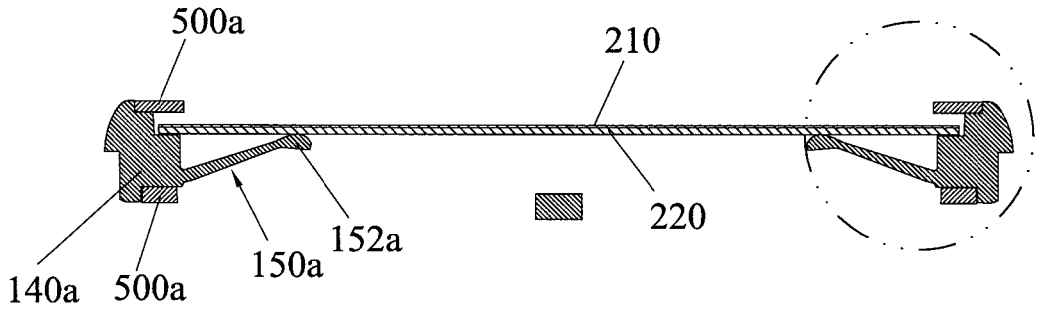
FIG. 7 is a schematic diagram of the razor head shown in FIG. 5 during use.
Figure 8:
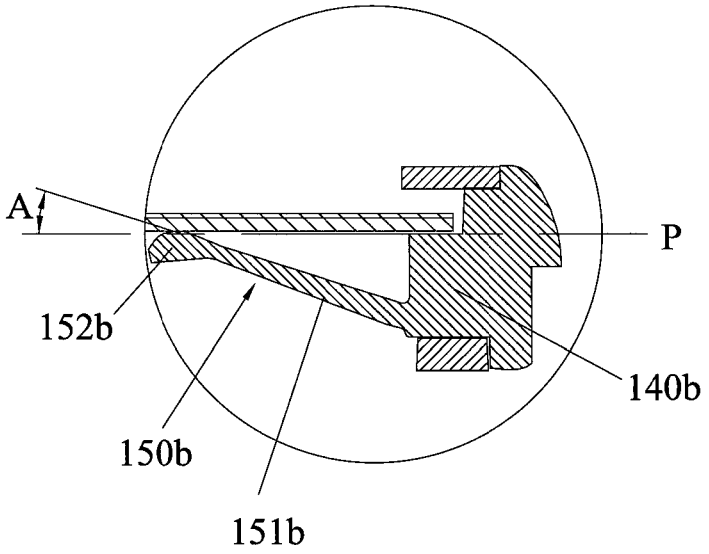
FIG. 8 is a partially enlarged view of the razor head shown in FIG. 7.

Referring to FIGS. 5-6 and FIG. 1, when the razor blade assemblies 200 and the restricted rings 500*a*, 500*b* are mounted on the outer frame 100, the resilient arms 150*a*, 150*b* rotate downwards around the connection position between that and the positioning blocks 140*a*, 140*b* relative to the initial state thereof (as shown in FIG. 2), and the head part 152*a* of the resilient arm 150*a* and the head part 152*b* of the resilient arm 150*b* synchronously move downwards with the same distance, and then the inclination angle A decreases. As the head parts 152*a*, 152*b* undergo a bias, thus an upward force applied to the razor blade holder 220 is generated. Therefore, after the razor blade assemblies 200 and the restricted rings 500*a*, 500*b* are mounted on the outer frame 100, the razor blade assemblies 200 are located above the positioning blocks 140*a*, 140*b* and elastically supported by the head parts 152*a*, 152*b* of the resilient arms 150*a*, 150*b*. During the use of the razor head 10, the razor blade assemblies 200 can be move downwards as shown in FIG. 5. When the razor blade assemblies 200 move downwards, the head parts 152*a*, 152*b* undergo a bias again, and then the inclination angle A decrease again, and the resilient arms 150*a*, 150*b* generate a further deformation. FIGS. 7-8 show a state of the razor blade assemblies 200 move downwards with the largest distance, the inclination angle A achieves to the minimum and the resilient arms 150*a*, 150*b* generate a maximum deformation under this case. Since the initial state of the inclination angle A is in the range of 25°~30°, thus the deformations of the resilient arms 150*a*, 150*b* are still within an allowable range, so as to provide a suitable supporting force to the razor blade assemblies 200 and prevent the fracture themselves, even if the inclination angle A changes during the state to be used and during the use of the razor head 10.

Figure 9:
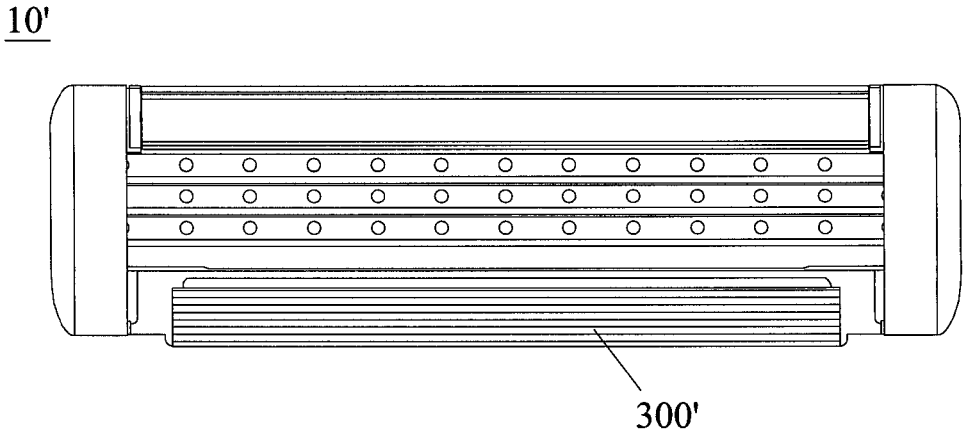
FIG. 9 is a schematic diagram of a razor head according to a second embodiment of the present invention.

FIG. 9 shows a razor head according to a second embodiment of the present invention. The razor head 10' of the second embodiment has a similar structure to that of the first embodiment, and the difference is that, the razor head 10' in the present embodiment has no guide roller, but a protective member 300' replaced. The protective member 300' can be wings form parallel to the razor blade assemblies 200 and arranged with spaced each other, or wings form parallel to and vertical with the razor blade assemblies 200 and arranged with spaced each other. The protective member 300' is used to strain the skin to be shaved during the shaving, so as to improve the shaving efficiency.

Compared with the prior art, the present invention provides a suitable inclination angle between the leg of the resilient arm of the outer frame and the said first plane P, so that the resilient arm can provide a suitable supporting force to the razor blade holder within its alterable range to be prevented from being fractured easily, and in turn improve the using performance of the outer frame and extend the lifetime thereof. Accordingly, the razor head of the present invention includes the outer frame so as to obtain a using performance and long lifetime.

The razor head of the present invention is not only applicable to the razors that the razor head and the handle are integrated together, but also applicable to the razors that the razor head and the handle are detachable.

Detailed structures of other parts of the razor head in the present invention are well known to the persons ordinarily skilled in the art and omitted herein therefore.

While the invention has been described in connection with what are presently considered to be the most practical and preferred embodiments. It is to be understood that the invention is not to be limited to the disclosed embodiments, but on the contrary, is intended to cover various modifications and equivalent arrangements included within the spirit and scope of the invention.

What is claimed is:

1. An outer frame of a razor head, comprising two side parts, a front part and a rear part connecting with the two side parts respectively; an inner side wall of each of the side parts being provided with a positioning block which has a first plane for mounting and supporting razor blade assemblies, resilient arms being connected with a side wall of the positioning block, and each of the resilient arm comprising a leg part connected with the positioning block and a head part connected with an end of the leg part; wherein an inclination angle between the leg part and the first plane is in the range of 25° to 30°, and the head part is extended out of the first plane; wherein the radius of curvature of a connection position between the leg and the positioning block is in the range of 0.03 mm to 1.0 mm.

2. The outer frame of a razor head of claim 1, wherein the inclination angle between the leg part and the first plane is 28°.

3. The outer frame of a razor head of claim 1, wherein the radius of curvature is in the range of 0.05 mm to 0.50 mm.

4. The outer frame of a razor head of claim 3, wherein the radius of curvature is in the range of 0.1 mm to 0.2 mm.

5. The outer frame of a razor head of claim 1, wherein the resilient arms and the positioning block are a unitary structure.

6. A razor head, comprising an outer frame, at least one razor blade assembly formed on the outer frame in parallel, and a restricted buckle for restricting the razor blade assembly on the outer frame, wherein the outer frame comprises two side parts, a front part and a rear part connecting with the two side parts respectively; an inner side wall of each of the side parts is provided with a positioning block which has a first plane for mounting and supporting razor blade assemblies, resilient arms are connected with side walls of the positioning blocks respectively, and each of the resilient arm comprises a leg part connected with the positioning block and a head part connected with an end of the leg part; wherein an inclination angle between the leg part and the first plane is in the range of 25° to 30°, and the head part is extended out of the first plane; wherein the radius of curvature of a connection position between the leg and the positioning block is in the range of 0.03 mm to 1.0 mm.

7. The razor head of claim 6, wherein the inclination angle between the leg part and the first plane is 28°.

8. The razor head of claim 6, wherein the radius of curvature is in the range of 0.05 mm to 0.50 mm.

9. The razor head of claim 8, wherein the radius of curvature is in the range of 0.1 mm to 0.2 mm.

10. The razor head of claim 6, wherein the resilient arms and the positioning block are a unitary structure.

* * * * *